US010468241B2

(12) United States Patent
Scime et al.

(10) Patent No.: US 10,468,241 B2
(45) Date of Patent: Nov. 5, 2019

(54) MONOLITHIC COLLIMATOR AND ENERGY ANALYZER FOR ION SPECTROMETRY

(71) Applicant: West Virginia University, Morgantown, WV (US)

(72) Inventors: Earl Scime, Morgantown, WV (US); Amy M. Keesee, Bridgeport, WV (US); Matthew Phillip Dugas, North Oaks, MN (US); Steven Brian Ellison, Woodbury, MN (US); Joseph Christopher David Tersteeg, Columbia Heights, MN (US); Drew B. Elliott, Morgantown, WV (US)

(73) Assignee: West Virginia University, Morgantown, WV (US)

( * ) Notice: Subject to any disclaimer, the term of this patent is extended or adjusted under 35 U.S.C. 154(b) by 233 days.

(21) Appl. No.: 15/479,231

(22) Filed: Apr. 4, 2017

(65) Prior Publication Data

US 2017/0287693 A1 Oct. 5, 2017

Related U.S. Application Data

(60) Provisional application No. 62/317,918, filed on Apr. 4, 2016.

(51) Int. Cl.
*H01J 49/48* (2006.01)
*H01J 49/06* (2006.01)

(52) U.S. Cl.
CPC ..... *H01J 49/48* (2013.01); *H01J 49/06* (2013.01)

(58) Field of Classification Search
CPC ..... H01J 49/48; H01J 49/06; H01J 2237/057; H01J 2237/30477; H01J 37/09; H01J 37/3171
USPC ..... 250/396 R, 396 ML, 492.1; 378/4; 382/131
See application file for complete search history.

(56) References Cited

U.S. PATENT DOCUMENTS

| | | | | |
|---|---|---|---|---|
| 9,502,229 | B2 * | 11/2016 | Scime | H01J 49/48 |
| 2008/0242980 | A1 * | 10/2008 | Lees | G01T 1/161 600/436 |
| 2009/0206270 | A1 * | 8/2009 | Glayish | H01J 37/05 250/396 ML |
| 2017/0287693 | A1 * | 10/2017 | Scime | H01J 49/48 |

* cited by examiner

*Primary Examiner* — David A Vanore
(74) *Attorney, Agent, or Firm* — Thomas Horstemeyer, LLP

(57) ABSTRACT

Disclosed are various examples related to ion or particle spectrometry utilizing a monolithic collimator and energy analyzer. In one example, a particle selection device includes a single substrate including a curved channel energy analyzer section and a straight channel collimator section, wherein particles pass through the collimator section and enter the energy analyzer section of the substrate. The channel outlets in the collimator section are aligned with the channel inlets of the energy analyzer section. Electric and/or magnetic fields can be applied across the channels of the energy analyzer for ion or particle discrimination. A particle detector at the outlet of the energy analyzer section can provide indications of detected ions and/or particles.

18 Claims, 11 Drawing Sheets

FIG. 12
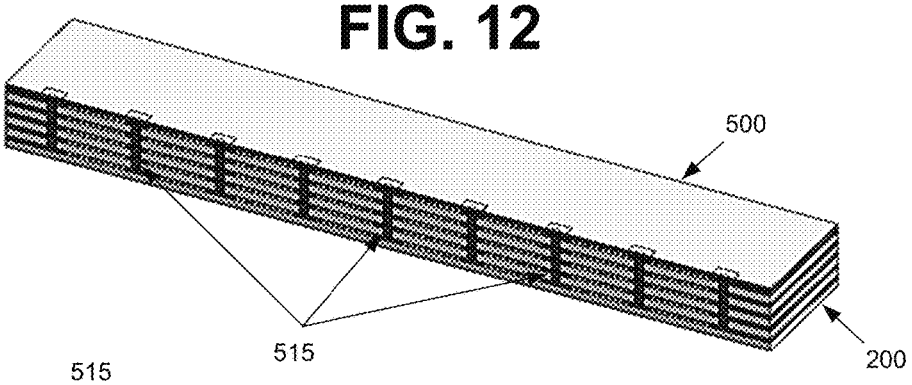
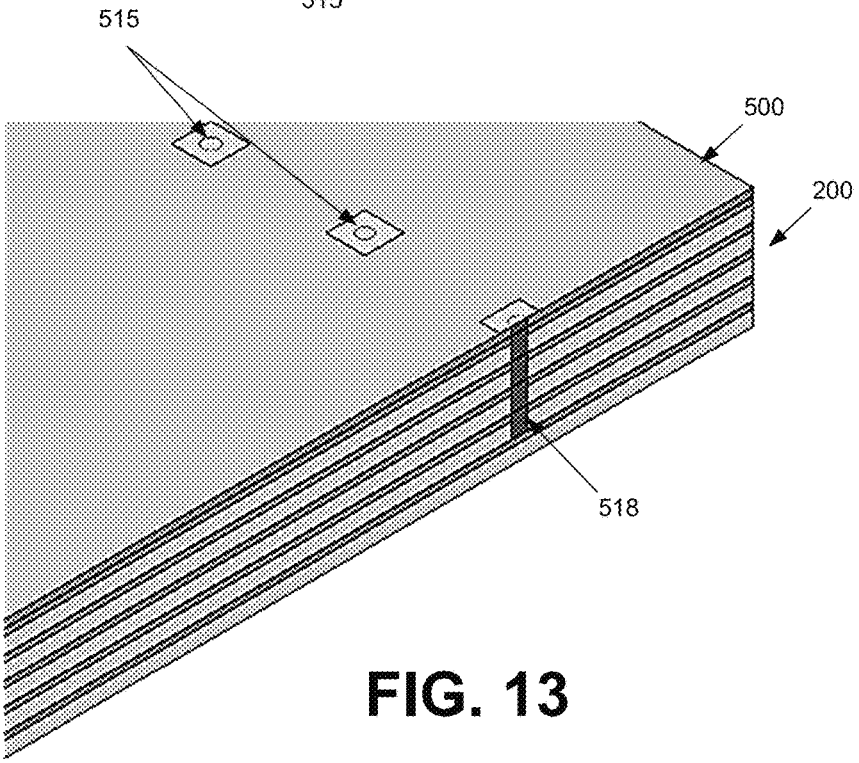
FIG. 13

MONOLITHIC COLLIMATOR AND ENERGY ANALYZER FOR ION SPECTROMETRY

CROSS-REFERENCE TO RELATED APPLICATIONS

This application claims priority to, and the benefit of, U.S. provisional application entitled, "Monolithic Collimator and Energy Analyzer for Ion Spectrometry," having Ser. No. 62/317,918, filed Apr. 4, 2016, which is hereby incorporated by reference in its entirety. This application is related to U.S. non-provisional application entitled, "Ultra-Compact Plasma Spectrometer," having Ser. No. 14/691,685, filed Apr. 21, 2015 (now U.S. Pat. No. 9,502,229, issued Nov. 22, 2016), which is hereby incorporated by reference in its entirety.

STATEMENT REGARDING FEDERALLY SPONSORED RESEARCH OR DEVELOPMENT

This invention was made with government support under contract number DE-SC0013841 awarded by the U.S. Department of Energy. The Government has certain rights in the invention.

BACKGROUND

Beginning with single spacecraft and progressing to recent multi-spacecraft missions, exploration of near-Earth space has increasingly focused on understanding the energy flow and coupling between different spatial regions through simultaneous measurements of essential plasma parameters, e.g., magnetic field, electric field, density, and temperature, over the relevant spatial length scales. The next step in multi-spacecraft missions is to go beyond missions consisting of a handful of large and sophisticated spacecraft to missions comprising large numbers of simple micro or pico-spacecraft.

SUMMARY

Included are various examples of systems and methods related to ion or particle spectrometry utilizing a monolithic collimator and energy analyzer. In one aspect, among others, a particle selection device comprises a single substrate including a curved channel energy analyzer section and a straight channel collimator section, wherein particles pass through the collimator section and enter the energy analyzer section of the substrate. In various aspects, the particle selection device can pass a selected particle through both the curved channel energy analyzer section and the straight channel collimator section to a particle detector. The particle selection device can be made on a wafer. The wafer can be a silicon wafer. The particle selection device can be made on the wafer using MEMs process techniques.

In various aspects, the energy analyzer section can be configured to apply a transverse electric field. Channels of the particle selection device can be closed with a secondary substrate configured to apply voltages across the channels. The energy analyzer section can be configured to apply a transverse magnetic field. Channels of the particle selection device can be closed with a secondary substrate configured to apply magnetic fields to the channel walls. The magnetic fields can be applied through an external coil. The secondary substrate can be a permanent magnet substrate. The particle selection device can be configured to apply magnetic fields through an external coil and the secondary substrate is constructed of a soft magnetic material. The secondary substrate can comprise a resistive network where a device electrode adjacent to energy bands is configured to bias the channels within the energy band.

In various aspects, the particle selection device can comprise a plurality of single substrates that are stacked. The plurality of single substrates can be connected with through substrate vias (TSVs). The particle selection device can comprise a plurality of stacked single substrates, each single substrate comprising at least one collimator section and at least one energy analyzer section. Channels of the particle selection device can be closed with a secondary substrate configured to apply voltages across the channels. Channels of the particle selection device can be closed with a secondary substrate configured to apply magnetic fields to the channel walls.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 10-13 are graphical representations illustrating examples of through substrate vias (TSVs) in monolithic collimator-energy analyzer chip of FIGS. 2-4 and closure chips (or cover plates) of FIGS. 5-7B in accordance with various embodiments of the present disclosure.

DETAILED DESCRIPTION

Disclosed herein are various examples related to ion or particle spectrometry utilizing a monolithic collimator and energy analyzer. A plasma spectrometer can include three elements: a collimating structure that defines the viewing geometry of the instrument and, ideally, can provide partial or complete shielding of the instrument from sunlight; an energy per charge or energy per mass resolving analyzer; and a particle detector. The collimator restricts the field of view (or angular resolution) of the instrument. The mass or energy per charge resolving analyzer (or energy analyzer) selects specific portions of the particle velocity or mass distribution (and separates the particles from any photons entering the instrument). In this way, an electrostatic analyzer 106 can distinguish species and eliminate background photons. The particles can then be detected by a detector using a variety of possible techniques known in the art.

Figure 1:
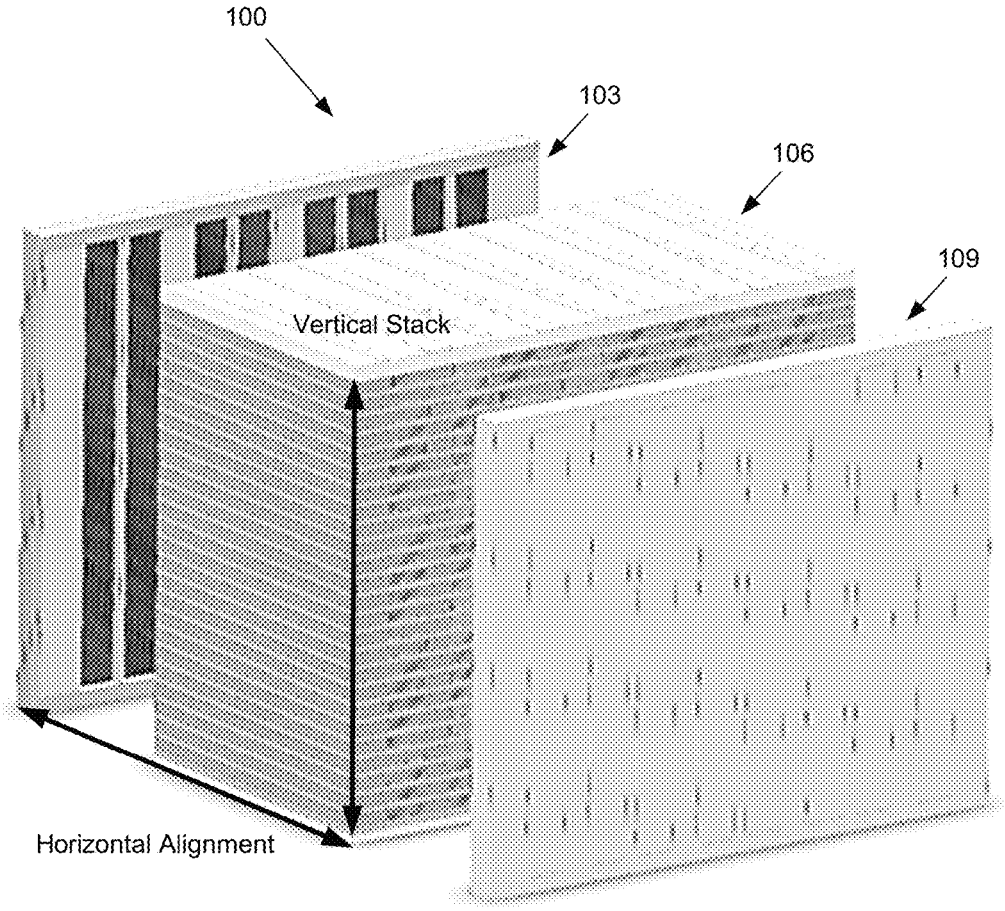
FIG. 1 is a graphical representation illustrating an example of a plasma spectrometer including separate collimator, energy analyzer and particle detector sections.

Microelectromechanical system (MEMS) fabrication techniques have been proposed for charged particle spectrometer systems. A recent patent (U.S. Pat. No. 9,502,229, issued Nov. 22, 2016, which is hereby incorporated by reference in its entirety) proposed MEMS fabrication whereby the collimator section (die or chips) is made on a dedicated collimator wafer and the companion curved plate energy analyzer section (die or chips) is likewise made on its respective dedicated wafer. FIG. 1 is a graphical representation illustrating an example of a plasma spectrometer 100 including separate collimator 103, energy analyzer 106 and particle detector 109 sections. A vertical stack of energy analyzer chips may be used for low density ions, otherwise a single energy analyzer chip can be used. The collimator chip(s) 103 and the energy analyzer chip(s) 109 are bonded together with post wafer fabrication chip to chip assembly techniques to obtain a MEMs fabricated ion spectrometer system. The horizontal alignment of the collimator 103 to the energy analyzer is an important aspect. A very tight tolerance for chip-to-chip bonding and alignment of the separate collimator and analyzer chips is needed when combining the collimator chip(s) and energy analyzer chip (s). Any tilt or skew with respect to the energy analyzer 106 may negatively impact the device performance. The detector 109 has a less critical alignment.

While these two different chips, collimator 103 and energy analyzer 106, are MEMs fabricated, they are not fabricated on the same substrate and hence are not monolithic. A monolithic collimator and curved plate energy analyzer single chip system has the advantage of reduced complexity over a system that uses separate collimator and energy analyzer chip(s). While certainly tractable and indeed buildable, removing the two wafer build approach and the post processing also has other advantages, some of which are described herein.

This disclosure eliminates complex steps by having the collimator and energy analyzer sections co-fabricated on the same chip and thus the corresponding wafer. It also makes the system more economical by reducing the number of fabricated wafers by a factor of 2. Furthermore, the methodology of this disclosure fully eliminates the need for chip level alignment and bonding of the collimator chip to the energy analyzer chip. This latter result, coupled with the wafer process efficiency could ultimately result in increased manufacturing efficiency by a factor of 4.

While a vertical chip stack of multiple energy analyzers is used for low density plasma environments, application to high density plasmas may only need one energy analyzer section. However, the alignment of the collimator 103 to the energy analyzer chip 106 remains an important operation for even a single energy analyzer chip instrument design, where the particle density is high enough to only need a single chip level system to analyze the ion particle species.

Figure 2:
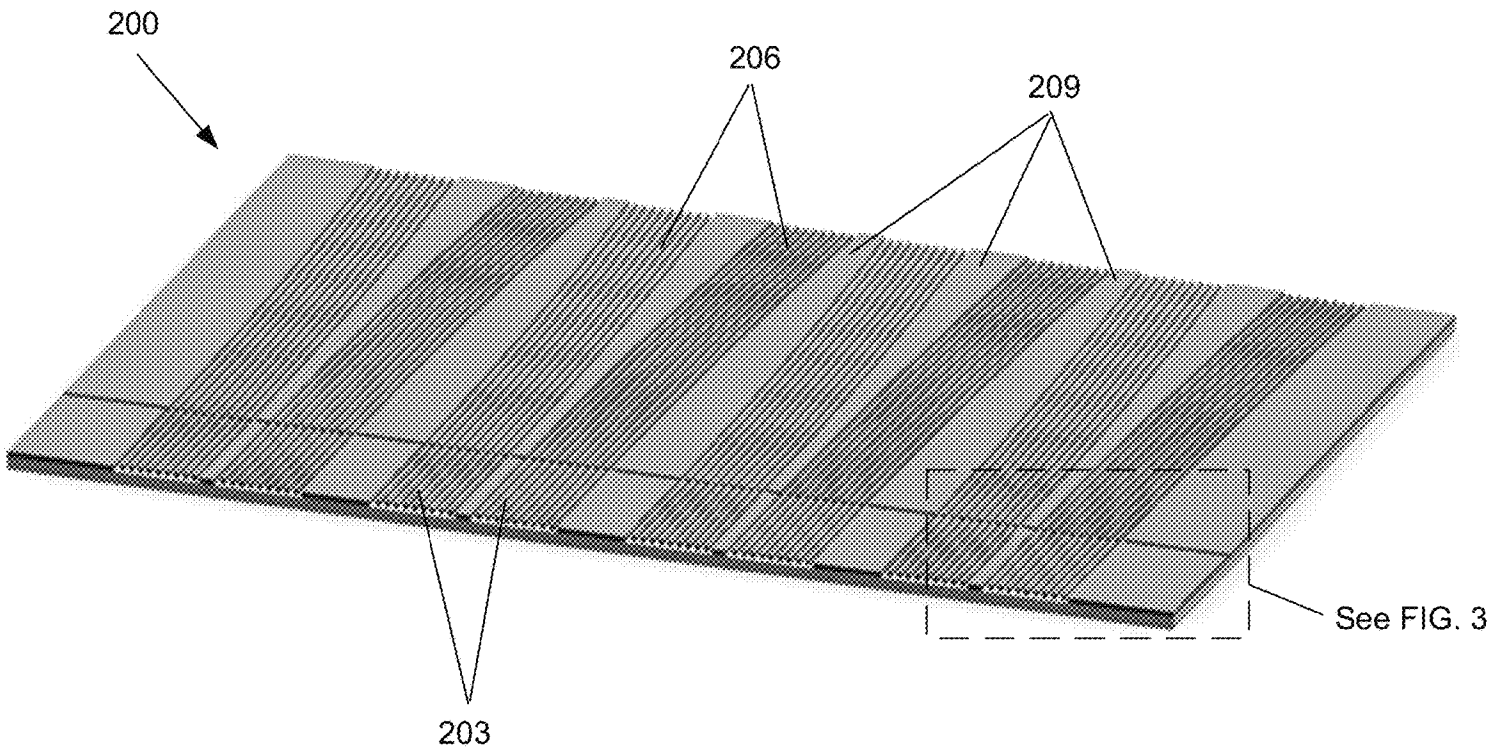
FIGS. 2, 3 and 4 are graphical representations illustrating an example of a monolithic collimator and energy analyzer chip (or plate), in accordance with various embodiments of the present disclosure.
Figure 3:
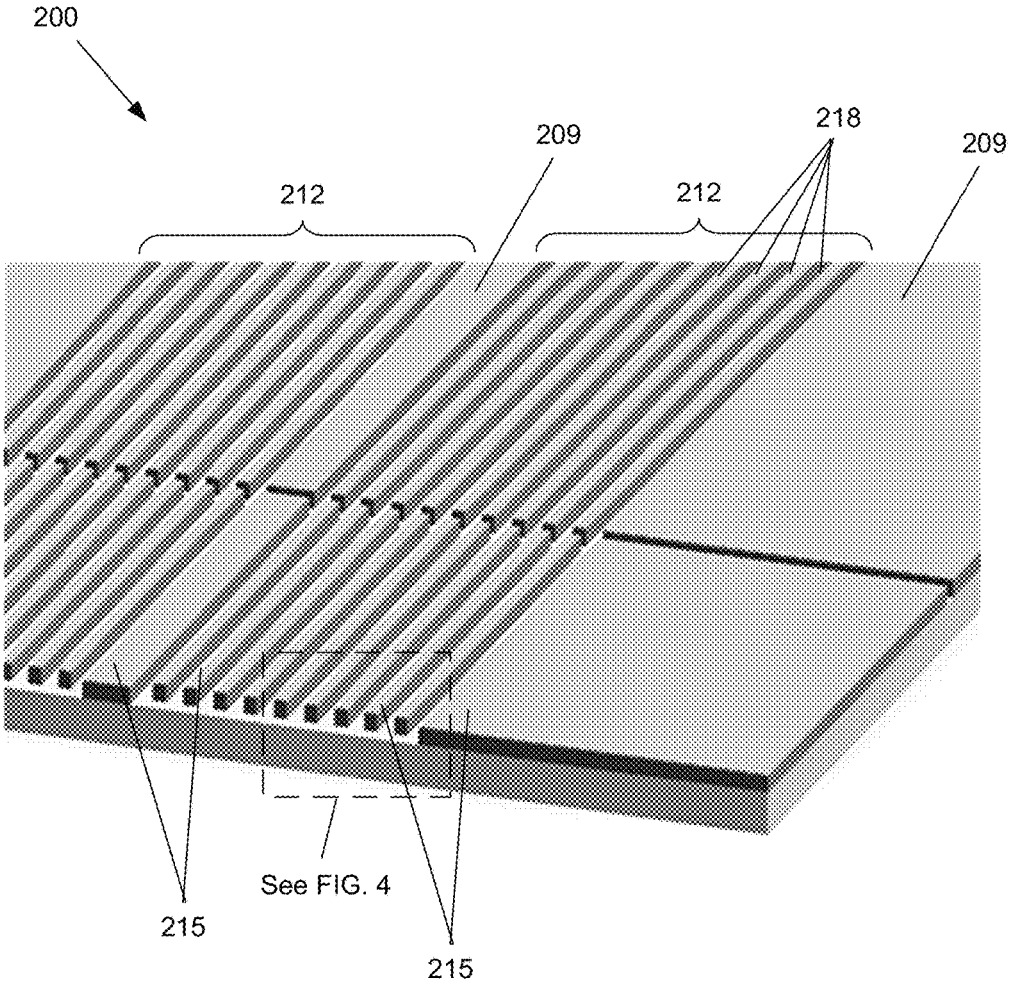

Referring to FIG. 2, shown is an example of a monolithic collimator-energy analyzer chip (or plate) 200 comprising collimator sections 203 and energy analyzer sections 206 formed on a common substrate. Electrodes 209 are also provided between the energy analyzer sections 206 for applying a bias voltage across the channels 212 of the energy analyzer sections 206. A portion of the monolithic chip 200 is enlarged in FIG. 3. The collimator sections 203 include collimator conductors 215 that are used for grounding the entire section. The electrodes (or electrode conductors) 209 are located on opposite sides of an analyzer section 206 to provide the bias voltage across the channels 212 (e.g., 10 channels) of the analyzer section 206. In the example of FIGS. 2 and 3, each energy analyzer section 206 comprises 10 channels, which are separated by conduction fins 218.

The electrodes 209 are the major sections adjacent to the energy analyzer sections 206. Each energy analyzer section 206 has two electrode conductors on opposite sides of the channels to allow a bias voltage to be applied across the intervening channels. A voltage drop occurs across each of the channel walls or fins 218. For example, if 25 volts is applied across an energy analyzer section of 10 channels, there is a voltage drop of about 2.5 V across each channel of the 10 channels set in-between the electrode conductors 209, effectively resulting in 10 parallel 2.5 V channels. In other embodiments, each channel may have an electric field (bias voltage) different from one another. With the addition of magnetic field biasing, ionization capabilities and/or micro-sized vacuum pumps in various combinations, the ultra-compact low power plasma spectrometers can be included in a broader range of applications which may require mass-to-charge measurement and analysis.

Figure 4:
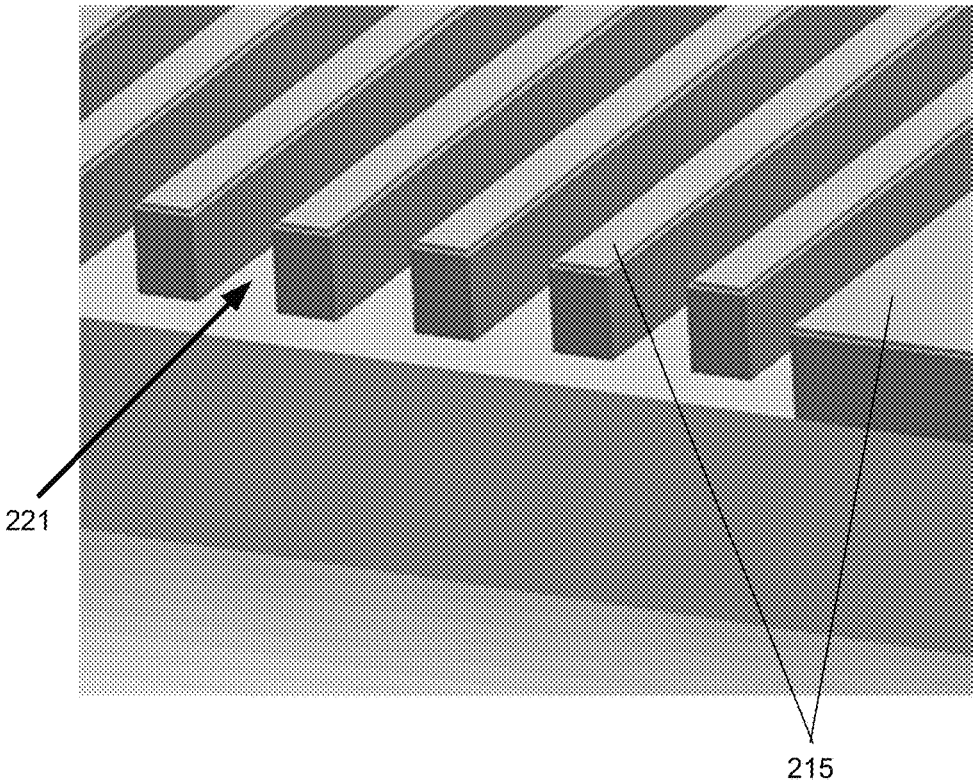

As seen in FIG. 4, the particle entrances 221 to the collimator sections 203 are defined by the channel size (e.g., 80 μm wide by 80 μm tall), which is bounded on the top by the bottom of the chip (or plate) positioned on top of that chip. In order for the device to be completed in a mechanical sense, and for the collimator channels in the uppermost (or top) chip (or plate) 200 to be bounded channels, a closure chip or plate can be bonded to the uppermost (or top) monolithic collimator-energy analyzer chip (or plate) 200 in the stack, over the plane of the etching process.

The monolithic collimator-energy analyzer chip (or plate) 200 can be designed and fabricated at wafer scale using semiconductor, thin film and MEMs level processing techniques. For example, the collimator and energy analyzer sections can fabricated with lithographic patterning, high aspect ratio deep reactive ion etching (DRIE) or other appropriate etching technique that can achieve the desired geometry of the elements, thin film deposition and patterning and 3D chip stacking (hybridization). For example, DRIE can be used on silicon to fabricate the collimator channels and the analyzer channels in a highly conductive silicon layer atop an insulating wafer (e.g., a standard silicon-on-insulator wafer). A mask pattern can be formed and patterned on the silicon using photo-resist, a hard mask, or other appropriate process for the desired design. As shown in FIGS. 2 and 3, a transverse channel can also be fabricated in the highly conductive silicon layer to separate the collimator sections 203 and energy analyzer sections 206. This wafer substrate may have the lower wafer made of SOI or a glass wafer. Wafer scale fabrication can result in a plurality of monolithic collimator-energy analyzer chips 200 being yielded per wafer.

Figure 5:
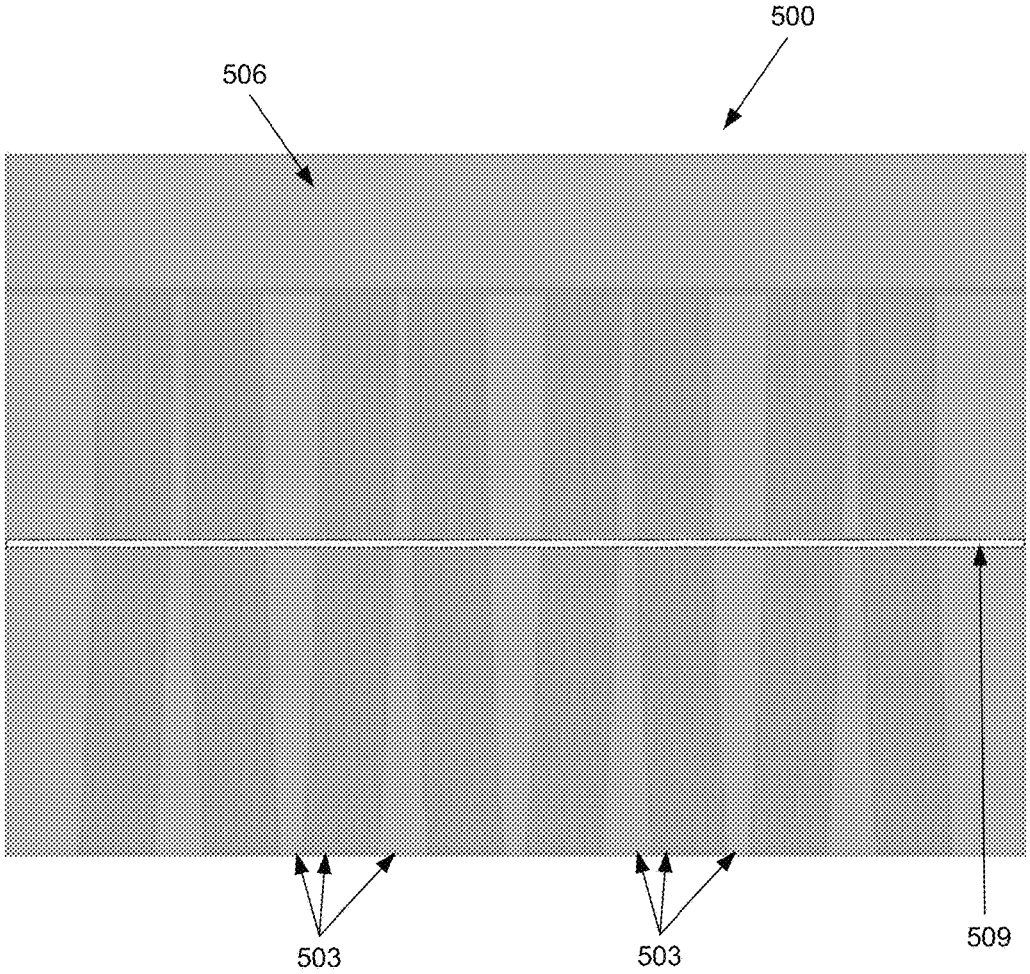
FIGS. 5, 6A, 6B, 7A and 7B are various views of an example of a closure chip (or cover plate) of the monolithic collimator-energy analyzer chip of FIGS. 2-4, in accordance with various embodiments of the present disclosure.

Referring next to FIG. 5, shown is a graphical representation illustrating an example of the backside (or bottom side) of a closure chip (or plate) 500. In one embodiment, the closure chip 500 comprises backside metal 503 (e.g., gold) which matches the topside metal of the monolithic collimator-energy analyzer chip 200 of FIG. 2. The closure chip (or cover plate) 500 can include leads for applying the external voltage to the system. In this way, the backside metal 503 gives a metal-to-metal bond and preserves the ability to have different voltages on the electrode conductors 209 and channel fins 218. The closure chip (or plate) 500 also includes ground metal 506 extending across one end of the backside to provide a ground connection to all of the collimator conductors 215.

The closure chip (or plate) 500 can also include a thin film resistive conductor 509, which is graphically illustrated as a dashed strip extending across the chip 500. The resistive conductor 509 lies underneath the conductive leads in the backside metal 503 and runs transverse to them. The resistive conductor 509 can be, e.g., a very thin tantalum nitride (TaN) conductor made upon the bottom of the closure chip (or cover plate) 500. It can be patterned so that this makes a resistor of about 1 kOhm to 1 MOhm, which is applied across all (or a portion) of the conductive leads as illustrated in FIG. 5. With the conductive leads in contact with the electrodes 209 and channel fins 218, the thin film resistive conductor 509 provides a pathway for charge to accumulate on the channel fins (or walls) 218 so that a precise transverse electric (or magnetic) field can be obtained across each channel. This thin film resistive conductor 509 can act as a resistive network or voltage divider network across and connecting the channel fins (or walls) 218 such that the charge on each of the channel fins (or walls) 218 is distributed to provide a consistent voltage drop, such as 2.5 V as in the example discussed above. The resulting precision electric field (V/m) provides a precision electric force (N) to ions entering the energy analyzer section of the instrument. Experiments were carried out and the results indicated better voltage control of the electrically isolated channel fins 218 if the voltage was intrinsically expressed across each channel of a given energy analyzer section.

If not already noted, the MEMs fabrication techniques of this design makes for very precision and very small channel widths. In one implementation, channel widths of 80 μm were used. As such, extremely large electric fields (V/m) can be produced across the channels with small voltages. This results in a very lower power device suitable for low power applications in comparison with other ion spectrometers. A TaN resistive conductor 509 is in the M-Ohm range across each channel fin 218, and thus the entire device can be powered with only milliWatts of power consumption.

Figure 6A:
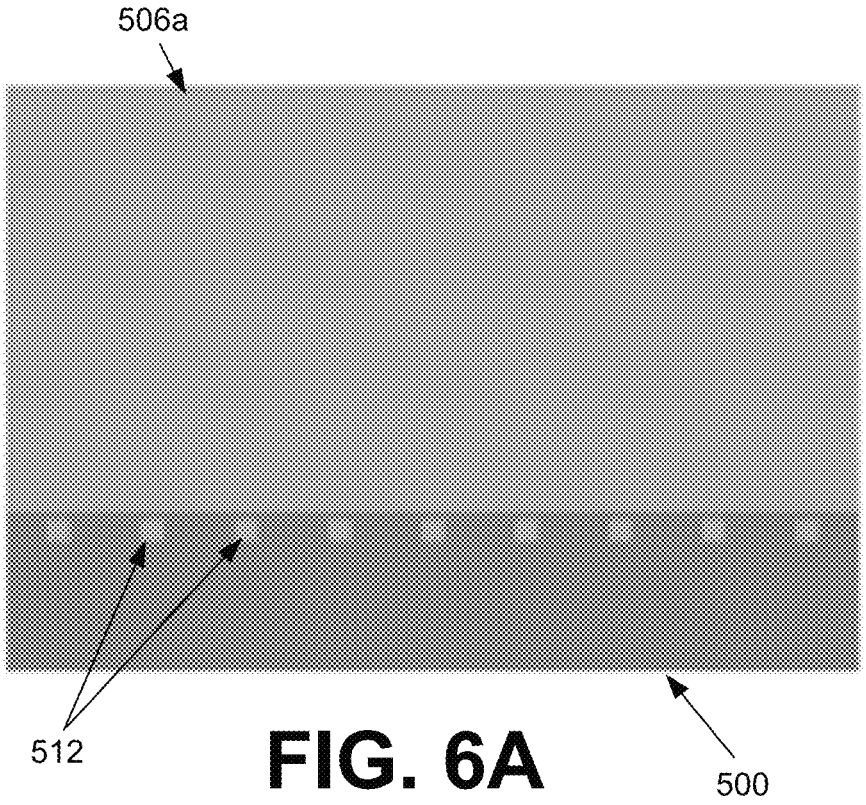
Figure 6B:
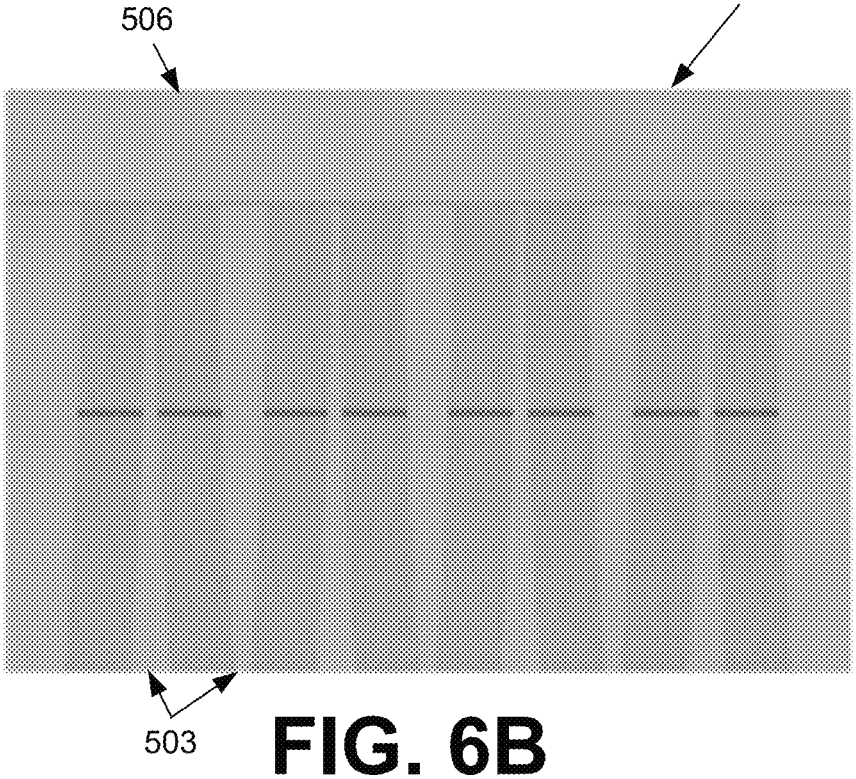

FIGS. 6A and 6B further illustrate the top side and bottom side, respectively, of the closure chip (or cover plate) 500 of FIG. 5. As shown in the example of FIG. 6A, ground metal 500*a* also provided on the top of the closure chip 500 for connection to all of the collimator fins 218. Connections between the bottom side ground metal 506 of FIG. 6B and top side ground metal 506*a* of FIG. 6A can be provided using one or more through substrate vias (TSVs). The top side ground metal 506*a* can be made large and closer to the electrode pads as a matter of convenience in connecting to the external voltage source. It should be noted that the thin film resistive conductor 509 is positioned between the energy analyzer channels and the top side ground metal 506*a* as illustrated by the dark lies across the energy analyzer sections.

Electrode voltage pads 512 can also be provided on the top of the closure chip (or plate) 500 as shown in FIG. 6A. The electrode voltage pads 512 can be positioned opposite the backside metal 503 (FIG. 6B) corresponding to the electrode conductors 209 of the monolithic collimator-energy analyzer chip (or plate) 200. For example, TSVs can be used to direct the external voltage bus applied to the electrode voltage pads 512 on the top side of the closure chip 500 to the backside metal 503 on the bottom side of the closure chip 500. Other types of connections between the two sides (e.g., side wall interconnections or interposer) can also be utilized as appropriate. Any pattern of connectivity is generally acceptable for getting the voltage and ground pads connected to the external system.

Figure 7A:
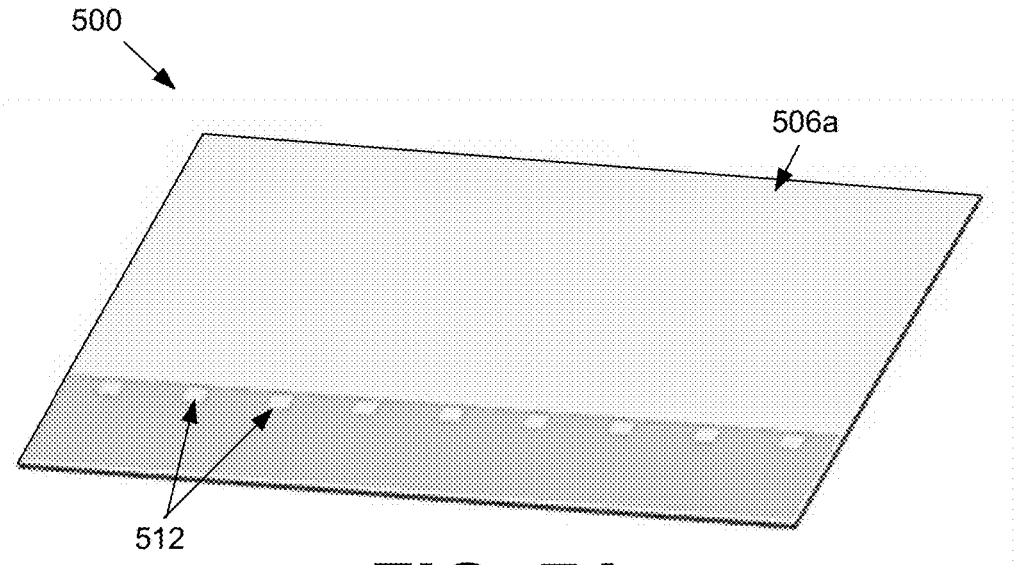
Figure 7B:
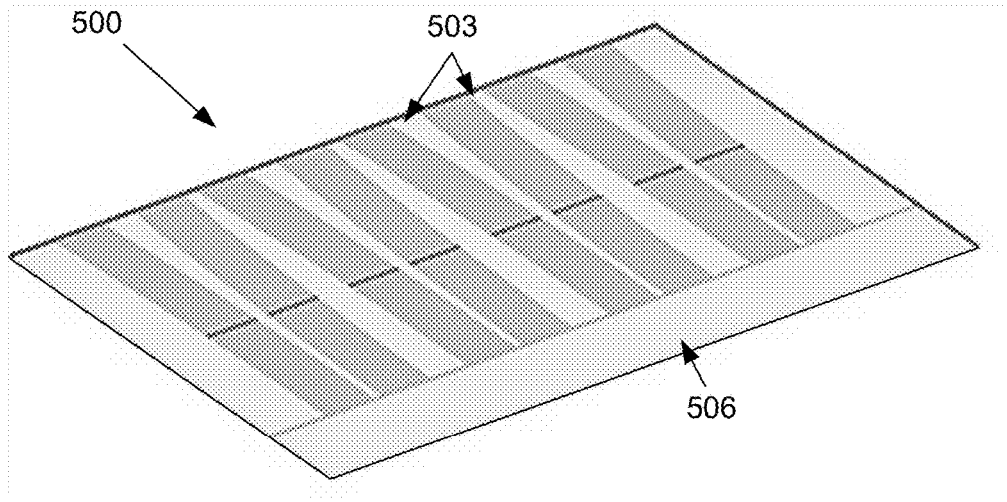

Perspective views of the closure chip (or cover plate) 500 are shown in FIGS. 7A and 7B. FIG. 7A illustrates the top side and FIG. 7B illustrates the bottom side of the cover plate 500. The closure chip (or cover plate) 500 may be made from a substrate (e.g., a non-conducting substrate) using double sided lithography and TSVs to make for easy connection to the external power supply and I/O signals.

Experiments and process development have achieved successful realization of gold metal on the surface of the channel walls defined by the DRIE etch process. Hence, the metallization of the top side of the channel fins 218 and/or electrodes 209 provides for connectivity to the underside of the closure chip (or cover plate) 500, which in turn provides for proper voltage division and precision voltage when coupled with the transverse thin film resistive conductor 509. The metallization can be carried out with gold, gold tin eutectic or any other conductive material that provides for both electrical and mechanical connectivity of the system. In a system utilizing a single monolithic collimator-energy analyzer chip, the connectivity is to the closure chip (or cover plate) 500 as previously presented. In multichip systems utilizing a stack of monolithic collimator-energy analyzer chips, the cover plate 500 will still be used at least on the uppermost (or top) chip (or plate) 200.

Figure 8A:
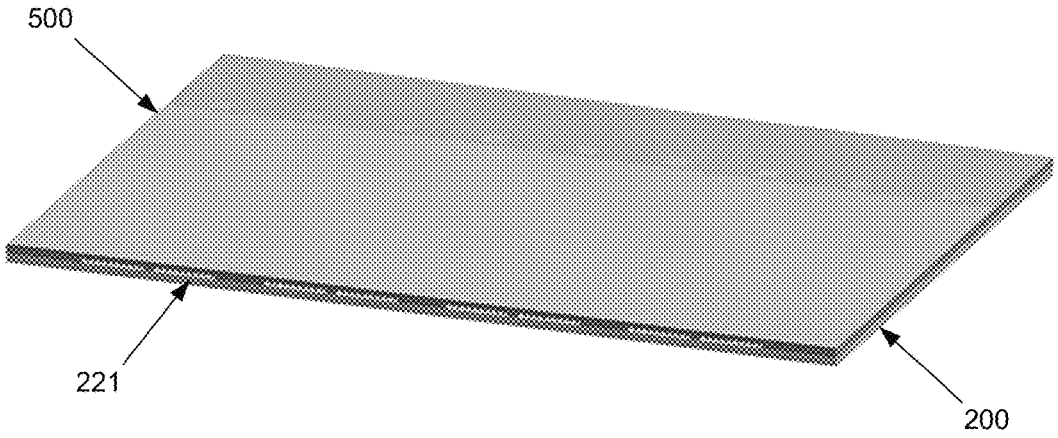
FIGS. 8A and 8B are graphical representations illustrating an example of a closure chip (or cover plate) of FIGS. 5-7B on a single monolithic collimator-energy analyzer chip of FIGS. 2-4, in accordance with various embodiments of the present disclosure.
Figure 8B:
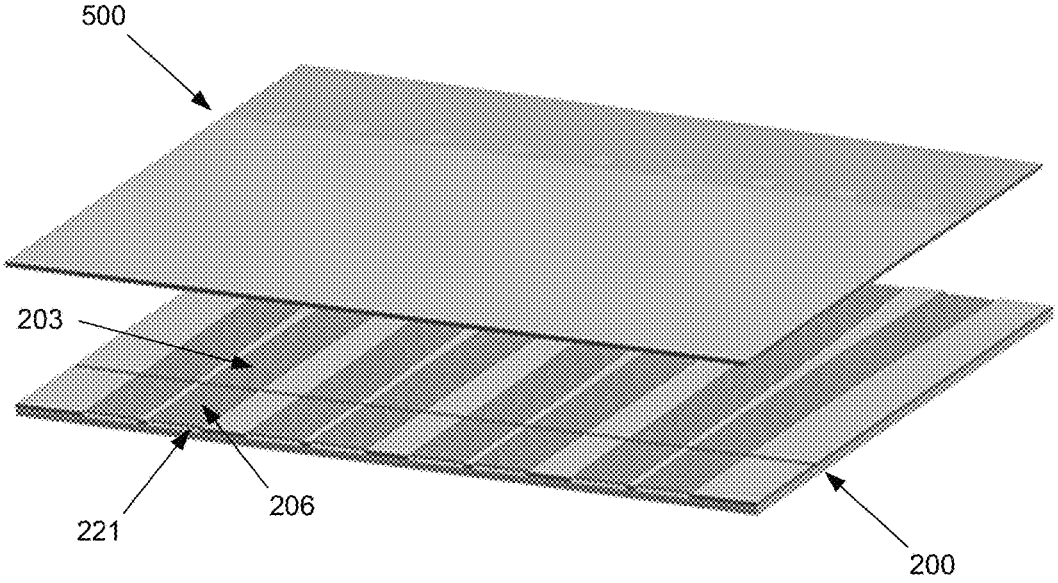

FIG. 8A is a graphical representation illustrating an example of a single layer collimator and energy analyzer for use with a particle detector in a plasma spectrometer or other device. As shown in the exploded view of FIG. 8B, the unit comprises a closure chip (or cover plate) 500 disposed on a single monolithic collimator-energy analyzer chip (or plate) 200. Ions enter the collimator sections 203 through particle entrances 221, passing through the collimator channels before entering the curved channels in the energy analysis sections 206, where they are exposed to the transverse electric (or magnetic) field established by the applied bias voltage, which alters the trajectories of the particles. Furthermore, the various sections of the channels of the energy analyzer 403 may be provisioned with electric fields and/or magnetic fields to discriminate various trajectories and mass-to-charge ratios in accordance with the principles of various ion and mass spectrometers. A particle detector at the outlet of the analyzer channels can provide measurements. Applications with high particle densities can utilize the single layer unit shown in FIGS. 8A and 8B.

For applications with lower particle densities, a unit comprising a stack of monolithic collimator-energy analyzer chips (or plates) 200 can be used. To enable stacking of the monolithic collimator-energy analyzer chips (or plates) 200, backside metallization and pattering, similar to that provided on the bottom of the closure chip (or cover plate) 500 in FIG. 5, is performed on the bottoms of the intermediate monolithic chips 200. Backside metal 503 (e.g., gold) which matches the topside metal of the monolithic collimator-energy analyzer chip 200 of FIG. 2 and ground metal 506 extending across one end of the backside are provided.

Figure 9A:
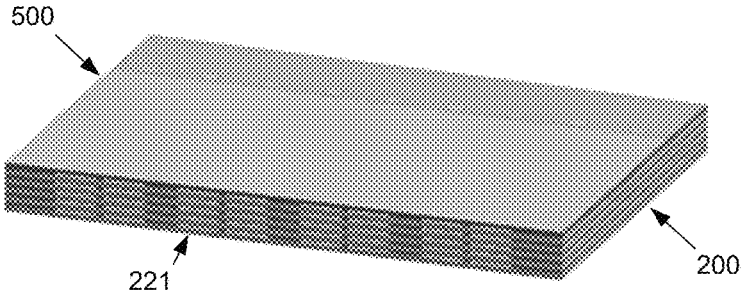
FIGS. 9A-9C are graphical representations illustrating an example of a closure chip (or cover plate) of FIGS. 5-7B on a stack of monolithic collimator-energy analyzer chips of FIGS. 2-4, in accordance with various embodiments of the present disclosure.
Figure 9B:
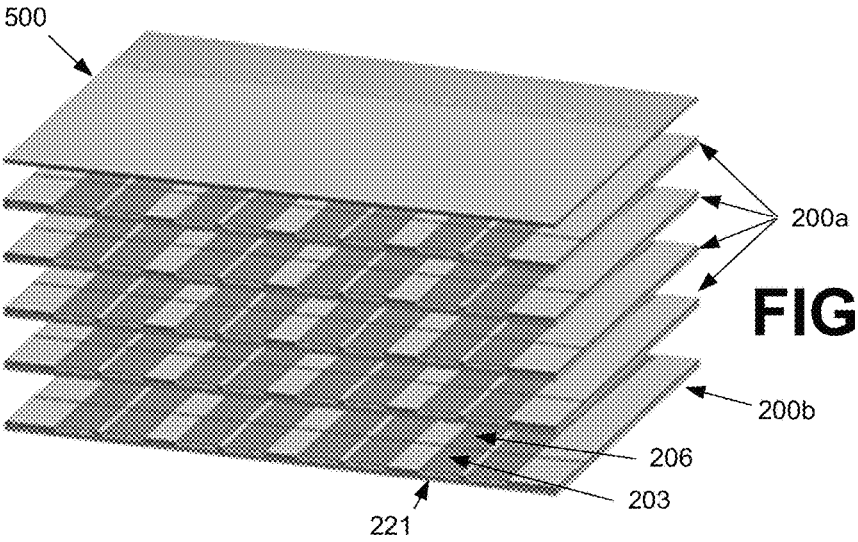
Figure 9C:
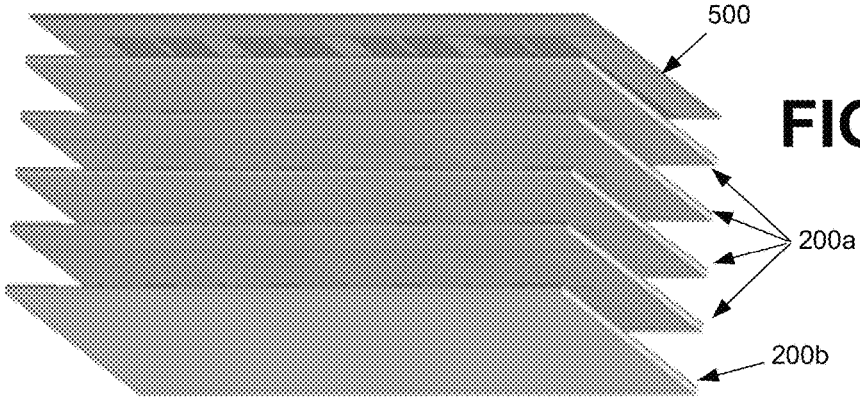

FIG. 9A is a graphical representation illustrating an example of a stacked layer collimator and energy analyzer for use with a particle detector in a plasma spectrometer or other device. As shown in the exploded views of FIGS. 9B and 9C, the unit comprises a closure chip (or cover plate) 500 over a stack of 5 monolithic collimator-energy analyzer chip (or plate) 200, which includes 4 intermediate monolithic chips 200*a* and a bottom monolithic chip 200*b*. As can be seen in FIG. 9C, the intermediate monolithic collimator-energy analyzer chips (or plates) 200*a* include backside metallization and pattering to facilitate the connections between the collimator conductors 215, and between the electrodes 209 and/or channel walls or fins 218. The closure chip 500 is disposed on the uppermost intermediate monolithic chip 200*a* in the stack. As in the single layer unit, ions enter the collimator sections 203 through particle entrances 221, passing through the collimator channels before entering the curved channels in the energy analysis sections 206, where they are exposed to the transverse electric (or magnetic) field established by the applied bias voltage, which alters the trajectories of the particles. Furthermore, the various sections of the channels of the energy analyzer 403 may be provisioned with electric fields and/or magnetic fields to discriminate various trajectories and mass-to-charge ratios in accordance with the principles of various ion and mass spectrometers. For example, magnetic fields can be applied through an external coil or through permanent magnet material in the substrate. The secondary substrate can be constructed of a soft magnetic material to facilitate the magnetic field. A particle detector at the outlet of the analyzer channels can provide measurements.

Figure 10:
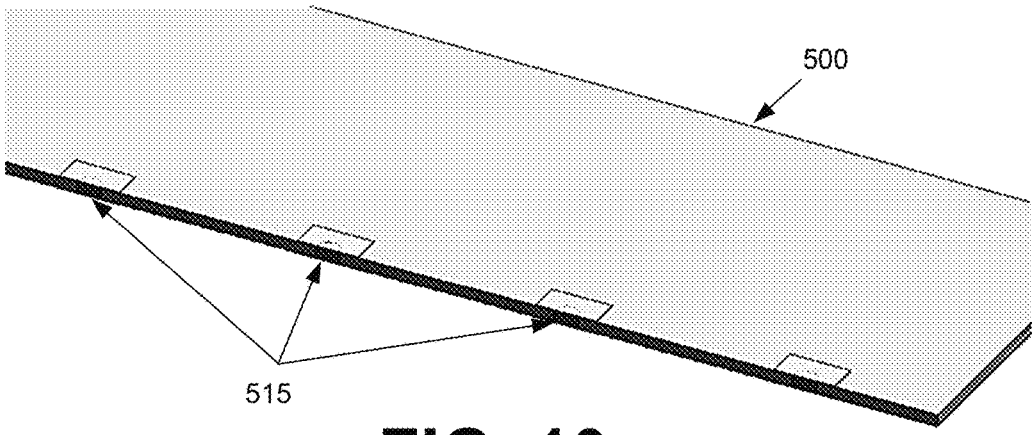
Figure 11:
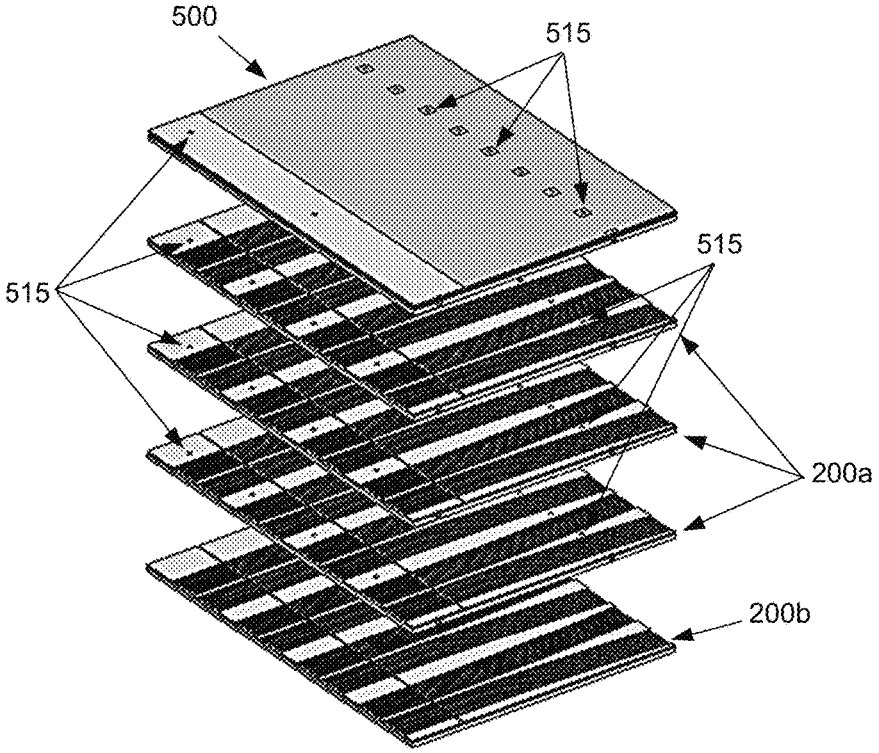

Connectivity between the closure chip 500 and/or monolithic collimator-energy analyzer chips 200 in the stack can be provided through TSVs, edge deposition, or other appropriate technique. FIGS. 10-13 illustrate examples of the chips 200/500 stacked and secured together using TSVs. FIG. 10 is a cross-sectional view illustrating TSVs 515 passing through the closure chip (or cover plate) 500. FIG. 11 further illustrates the use of the TVSs 515 to provide connections between the closure chip 500 and monolithic chips 200. TVSs 515 can be used to provide connections between the electrodes 209 of the energy analyzer 206 and collimator conductors 215 of the collimator 203. The intermediate monolithic chips 200*a* can include a thin film resistive conductor 509 to provide uniform fields across the analyzer channels. FIG. 12 is a cross-sectional view illustrating the TSVs 515 passing through the stack of chips 200/500. FIG. 13 illustrates an example of a side wall interconnection 518 between the chips 200/500.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A particle selection device, comprising:

a single substrate including a curved channel energy analyzer section and a straight channel collimator section, wherein particles pass through the straight channel collimator section and enter the curved channel energy analyzer section of the substrate.

2. The particle selection device of claim 1, wherein the particle selection device passes a selected particle through both the curved channel energy analyzer section and the straight channel collimator section to a particle detector.

3. The particle selection device of claim 1, wherein the particle selection device is made on a wafer.

4. The particle selection device of claim 3, wherein the wafer is a silicon wafer.

5. The particle selection device of claim 3, wherein the particle selection device is made on the wafer using MEMs process techniques.

6. The particle selection device of claim 1, wherein the curved channel energy analyzer section is configured to apply a transverse electric field.

7. The device of claim 6, wherein channels of the particle selection device are closed with a secondary substrate configured to apply voltages across the channels.

8. The particle selection device of claim 1, wherein the curved channel energy analyzer section is configured to apply a transverse magnetic field.

9. The particle selection device of claim 8, wherein channels of the particle selection device are closed with a secondary substrate configured to apply magnetic fields to walls of the channels.

10. The particle selection device of claim 9, wherein the magnetic fields are applied through an external coil.

11. The particle selection device of claim 9 wherein the secondary substrate is a permanent magnet substrate.

12. The particle selection device of claim 8, wherein the particle selection device is configured to apply magnetic fields through an external coil and the secondary substrate is constructed of a soft magnetic material.

13. The particle selection device of claim 8, wherein the secondary substrate comprises a resistive network where a device electrode adjacent to energy bands is configured to bias the channels within the energy band.

14. The particle selection device of claim 1, comprising a plurality of stacked single substrates, each single substrate of the plurality of stacked single substrates comprising at least one straight channel collimator section and at least one curved channel energy analyzer section.

15. The particle selection device of claim 1, comprising a plurality of single substrates that are stacked.

16. The particle selection device of claim 15, wherein the plurality of single substrates are connected with through substrate vias (TSVs).

17. The device of claim 1, wherein channels of the particle selection device are closed with a secondary substrate configured to apply voltages across the channels.

18. The particle selection device of claim 1, wherein channels of the particle selection device are closed with a secondary substrate configured to apply magnetic fields to walls of the channels.

* * * * *